US011547927B2

(12) United States Patent
Byrne

(10) Patent No.: US 11,547,927 B2
(45) Date of Patent: Jan. 10, 2023

(54) TABLE GAME USING A HARD BALL

(71) Applicant: Christopher Russell Byrne, Legana (AU)

(72) Inventor: Christopher Russell Byrne, Legana (AU)

( * ) Notice: Subject to any disclaimer, the term of this patent is extended or adjusted under 35 U.S.C. 154(b) by 65 days.

(21) Appl. No.: 17/029,671

(22) Filed: Sep. 23, 2020

(65) Prior Publication Data

US 2021/0106903 A1 Apr. 15, 2021

(51) Int. Cl.

| | |
|---|---|
| ***A63F 7/06*** | (2006.01) |
| ***A63D 15/00*** | (2006.01) |
| ***G07F 17/38*** | (2006.01) |
| ***G07F 17/32*** | (2006.01) |

(52) U.S. Cl.

CPC ..... *A63D 15/00* (2013.01); *G07F 17/329* (2013.01); *G07F 17/3213* (2013.01); *G07F 17/3253* (2013.01); *G07F 17/3288* (2013.01); *G07F 17/38* (2013.01)

(58) Field of Classification Search

None

See application file for complete search history.

(56) References Cited

U.S. PATENT DOCUMENTS

| | | | | |
|---|---|---|---|---|
| 2,806,701 | A * | 9/1957 | Durant | G07F 17/38 273/125 A |
| 4,948,133 | A * | 8/1990 | Helm | A63F 7/0058 273/124 A |
| 5,031,919 | A * | 7/1991 | Dixon | A63F 7/0005 273/352 |
| 7,111,846 | B1 * | 9/2006 | Breslow | G07F 17/3297 273/342 |
| 7,857,316 | B2 * | 12/2010 | Shoemaker, Jr. | G07F 17/3297 273/317 |
| 2019/0168106 | A1 * | 6/2019 | Cartwright | A63D 15/006 |

* cited by examiner

*Primary Examiner* — Sunit Pandya

(74) *Attorney, Agent, or Firm* — Edwin D. Schindler

(57) ABSTRACT

A table game, includes a game surface having a plurality of holes therein, a plurality of balls for contacting the game surface and being of a diameter allowing each ball of the plurality of balls to be passed or thrown into each hole of the plurality of holes of the game surface, along with a manner for players to thrown balls onto the game surface and scoring players, preferably depending upon the location of the ball thrown onto the game surface.

7 Claims, 16 Drawing Sheets

TABLE GAME USING A HARD BALL

BACKGROUND OF THE INVENTION

Technical Field of the Invention

Figure 1:
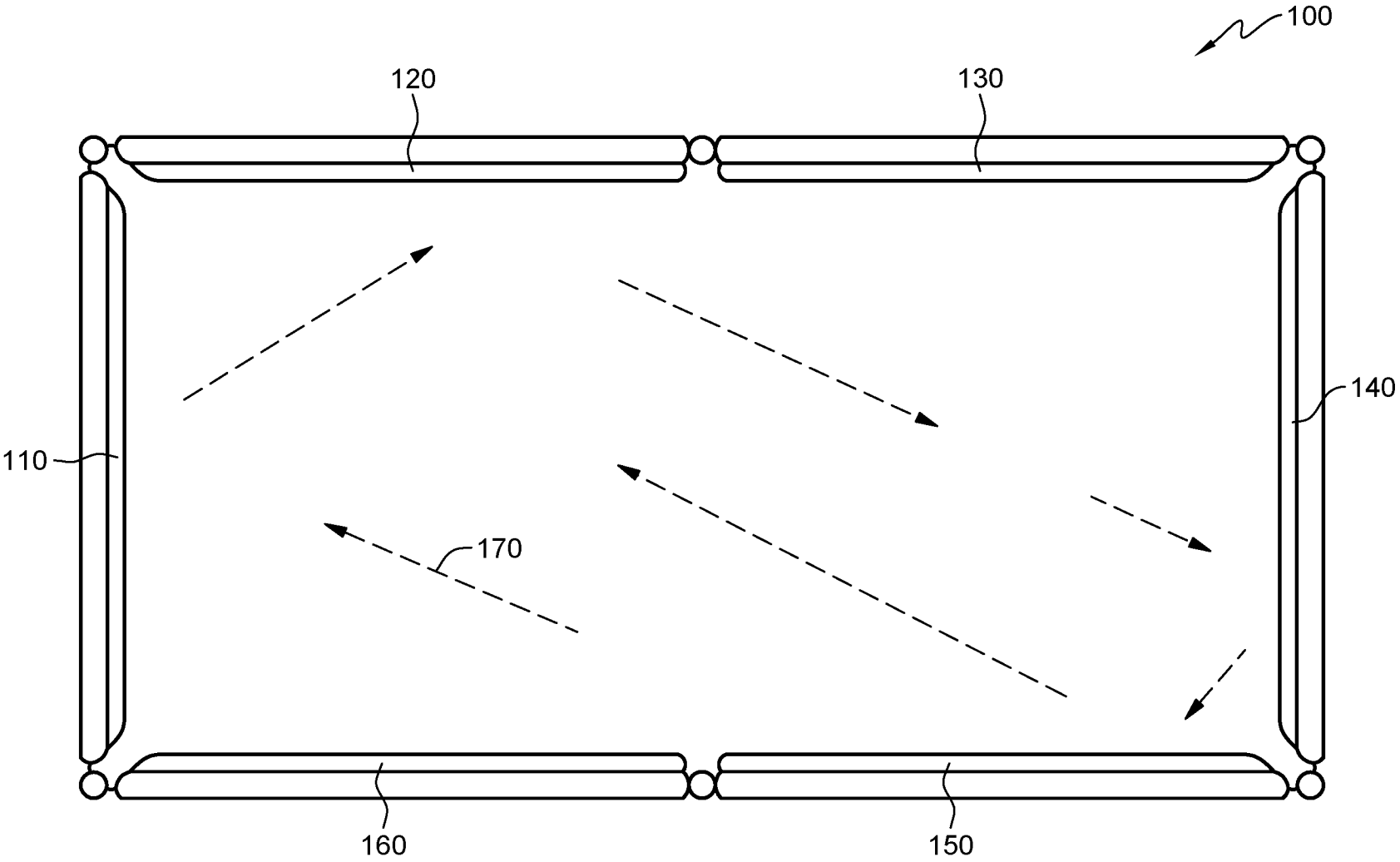

The present invention relates, generally, to a table game using a hard ball, such as a billiard ball.

More particularly, the present invention relates to a billiard table and billiard/eight ball and apparatus in combination.

Description of the Prior Art

Billiard tables and billiard balls are not new and have been around for more than a century, and have been used in games, such as, billiards, snooker and 8-ball in combination with the use of a cue or stick.

SUMMARY OF THE INVENTION

The present invention present a novel game used in conjunction with a full-sized billiard table and billiard, snooker or eight balls and a electronic system using a pressure mat and a siren, alarm or buzzer and "Pressure On" display to alert notification as will further be described. No cue or stick is used in this game. The ball is launched with the hand movement of the player. Further serves. shots, which player goes next, and deliveries are also delivered by the hand, palm or fingers of players in a controlled sweeping motion, thereby causing the billiard ball to move across the billiard table in the desired direction, and may include a chute controlled by the hand of a player. Points are scored and the game proceeds, as further described hereinafter.

Other objects and features of the present invention will become apparent when considered in combination with the accompanying drawing figures, which illustrate certain preferred embodiment of the present invention. It should, however, be noted that the accompanying drawing figures are intended to illustrate only select preferred embodiments of the claimed invention and are not intended as a means for defining the limits and scope of the invention.

BRIEF DESCRIPTION OF THE DRAWING FIGURES

In the drawing figures, wherein similar features are denoted with similar reference numerals throughout the several views:

FIGS. 1-16 show various charts informing of the instructions for playing the game of the present invention.

DETAILED DESCRIPTION OF THE DRAWING FIGURES AND PREFERRED EMBODIMENTS

Turning now, in detail, to the drawing figures and a detailed description of the game of the present invention, to begin the player holds the ball in hand and gets ready for first shot, when time is correct or the player is ready the player launches the billiard/snooker/8-ball in the direction, as shown in FIG. 1. Shot 1 along the billiard table across the belt cloth from position F or E ("Shot 1") towards cushion A, the ball is then required to bounce off cushion B and then onto cushion D, C, E or F (and bounced off B to become active.)

Figure 2:
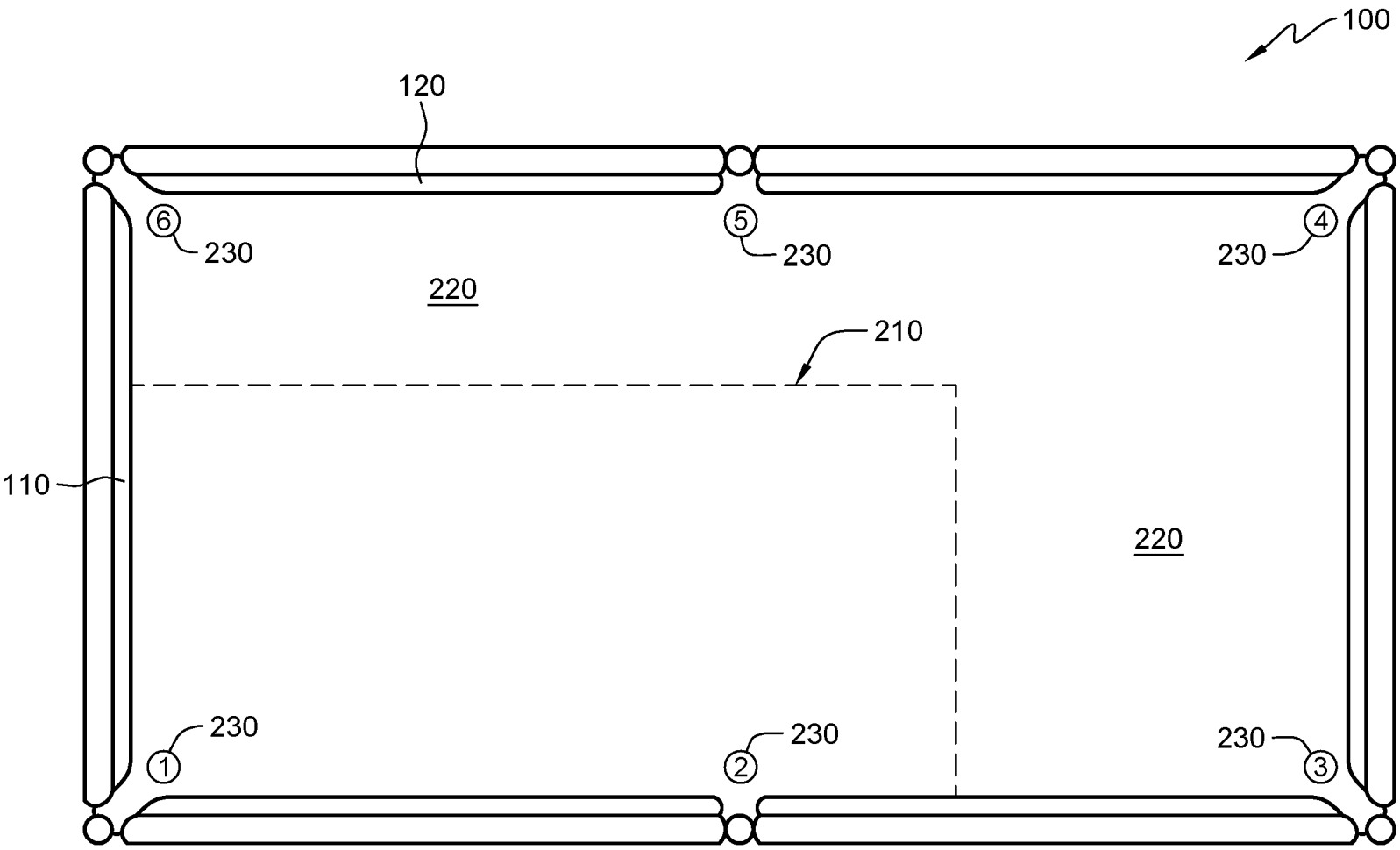

The aim of the game in this first instance is (a) to put the ball in one of the pockets to score a number associated with the pocket or (b) to pot or knock in a numbered ball placed over the pockets as shown in FIG. 2 or (c) to be the first player to put the ball in any of the pockets and score a number associated with the pocket as shown in FIG. 2 or (d) to be the player who can continue the serving process the longest before the player's ball stops in a "No Play Zone," as shown in FIG. 2.

Using a billiard ball, or snooker ball or 8-ball, hereinafter referred to as simply "ball," to describe the serving process, initially, the ball is held in hand (or from a position on the table) and released in a sweeping launching movement propelling the ball across the billiard table as shown in FIG. 1. The ball must reach cushion A then bounce onto cushion B then onto cushion D to become "Active." When the ball is Active it can now score and produce results. The ball can either go in any of the pockets winning a particular result or the ball can simply come to rest on a particular place on the billiard table's layout or felt giving a particular result as required by the operator.

This concept can be applied to many applications, using a particular billiard table or felt cover with the game information as required and a ball as prior specified in the manner as prior specified on a standard full-sized billiard/snooker/8 Ball-table. It has been determined by the inventor that it is preferable to use a full sized table 12'×6' and billiard ball or snooker ball or 8-ball for best results. Again, the ball is released onto the billiard table surface onto the felt cloth towards cushion A, then ball must propel (move) onto cushion B, as shown in FIG. 1, then must further move on to cushion D after the time the ball becomes Active and can therefore score points by going in a pocket or coming to rest on a desired marked shown winning/losing area.

This game can be used as promotional platform for gambling and gambling apparatus, which can be put (painted image or projected image) on a felt cover (cloth), which is used to cover the billiard/snooker/8-Ball table. When the ball comes to rest after satisfying the launching (and to become Active) requirements, the place of rest can indicate the amount of win or loss as required by the gaming application. The gambling aspects of this concept will be shown FIGS. 1-12 hereinafter.

In some cases, it is required that the ball be kept in motion by the player, away from the pockets with no aim to put the ball in any pocket for 3 rotations around the table (3 shots/goes or player turns/serves/deliveries) after the ball has become Active and before a result can be achieved.

In certain preferred embodiments of the game of the present invention, it is required that the ball be kept in motion following the designated paths and directions as described above, but aimed away from the pockets with no aim to put the ball in any pocket for three rotations around the table (3 shots/goes or player turns/serves/deliveries) after the ball has become Active (as prior discussed) before a result can be achieved.

The standard cloth which covers any billiard table is generally made from felt and is green in color with only the "D"-shape marked on the felt to show players where to place their ball when they begin play for any snooker, billiard or 8-ball applications; the cloth may be different colors but generally has no other different design printed on the cloth/felt.

It is an object of the present invention, use the billiard table and ball as previously described on the table, but with different designs printed/painted/projected on the table cloth/felt cover to enable a particular game to be played. The ball is launched by hand as prior described in the number of goes as required as prior described and propelled around the table off the cushions as prior described to achieve a particular result placed and shown on the table cloth layout as printed/projected as a design to achieve result.

Figure 3:
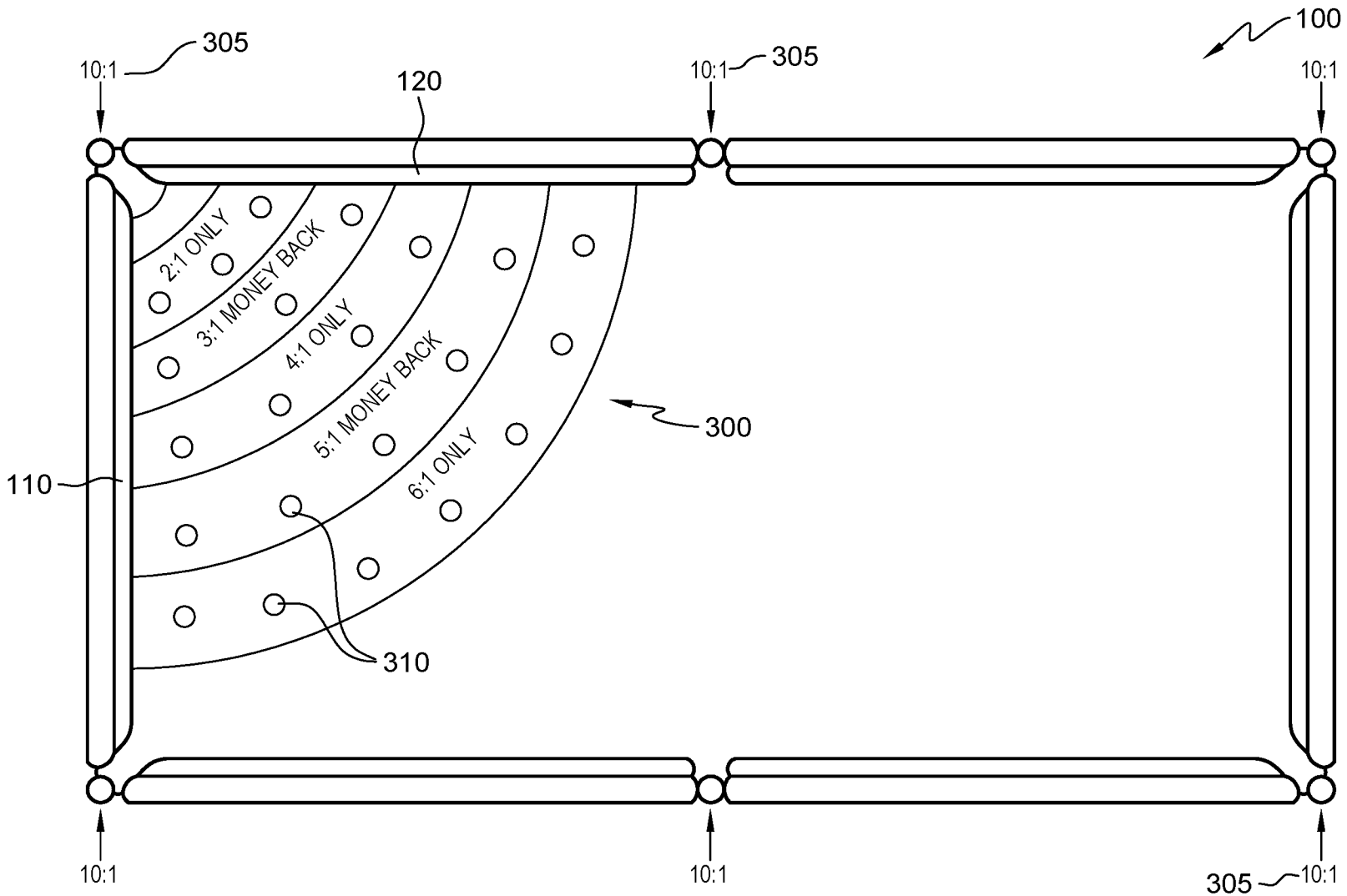

A variety of examples will now be presented to illustrate a number of billiard table cloth/felt cover designs which achieve varied required results as per each given application; each application can be associated with a particular game. Examples which follow will be gaming applications examples, as presented in FIGS. 1-12:

Example 1, FIG. 3: TV Betting/casino game/phone app betting game. The ball is launched onto cushion A as prior described resulting onto cushion D as prior described then when the ball comes to rest on any of the shown areas inside the circles in the shown area with the associated value result in the shown area, the result is known. In the "money back" areas, the money is refunded. In the "only" areas, e.g., 2:1 only, 4:1 only, 10:1 only, etc., areas, the ball must land inside the circle completely to achieve the prize, as shown, if landing outside these areas (outside the circles) the wager is lost.

Figure 4:
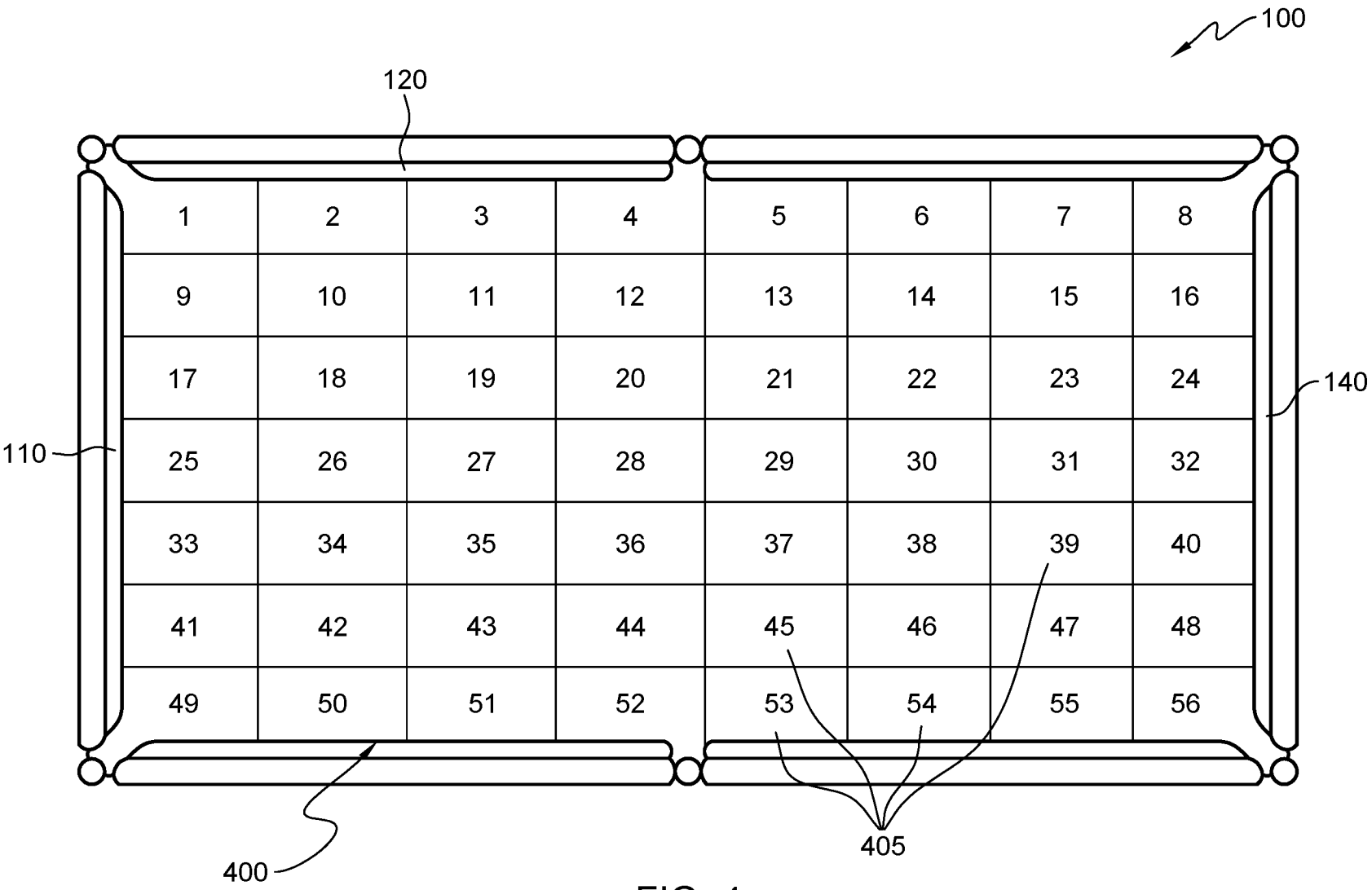

Example 2, FIG. 4: A new way to draw lotto/keno/bingo numbers. The ball is launched from the hand onto the billiard table, as previously, described when the ball comes to rest in any of the given numbered areas the result is known. This process may be repeated to draw the required amount of balls. This same concept can also be applied to roulette, keno, bingo or lotto to achieve same desired result.

Figure 5:
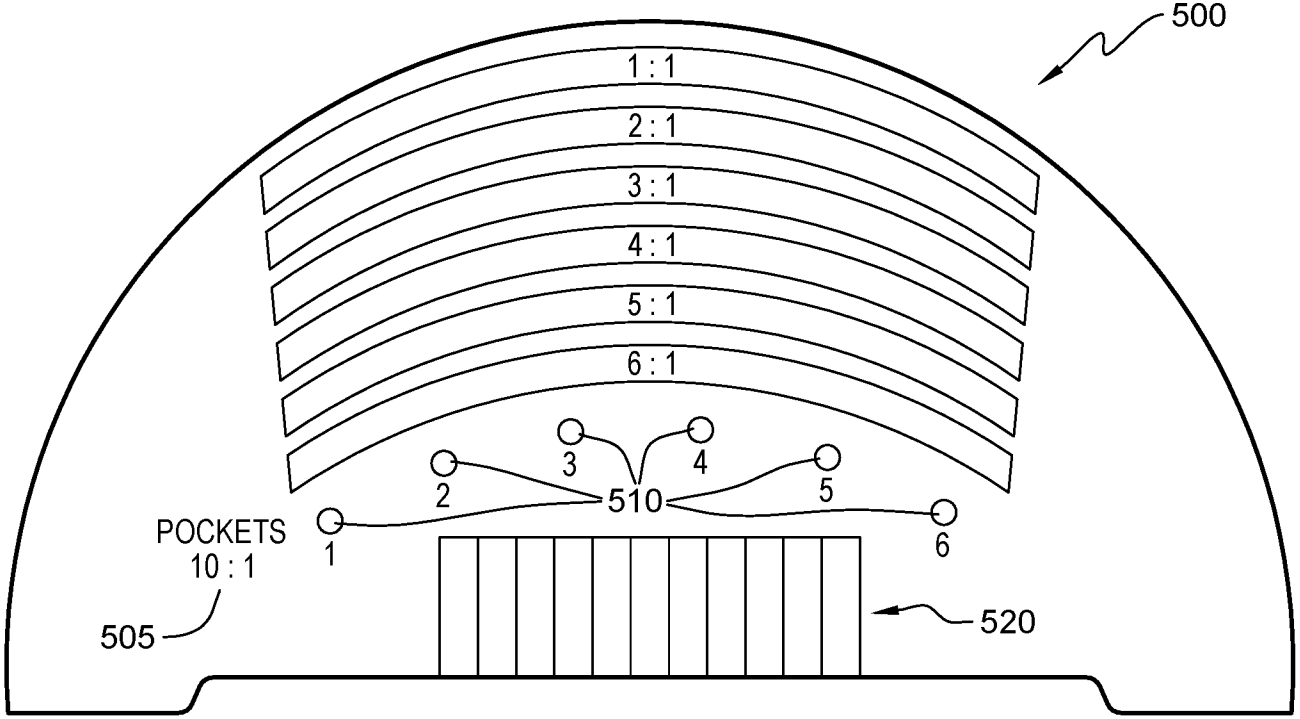

FIG. 5 shows a casino betting table which accepts wagers, showing odds placements of 1:1, 2:1, 3:1, 4:1, 5:1, 6:1 and 10:1. A betting chip tray is designated by reference numeral 520.

Figure 6:
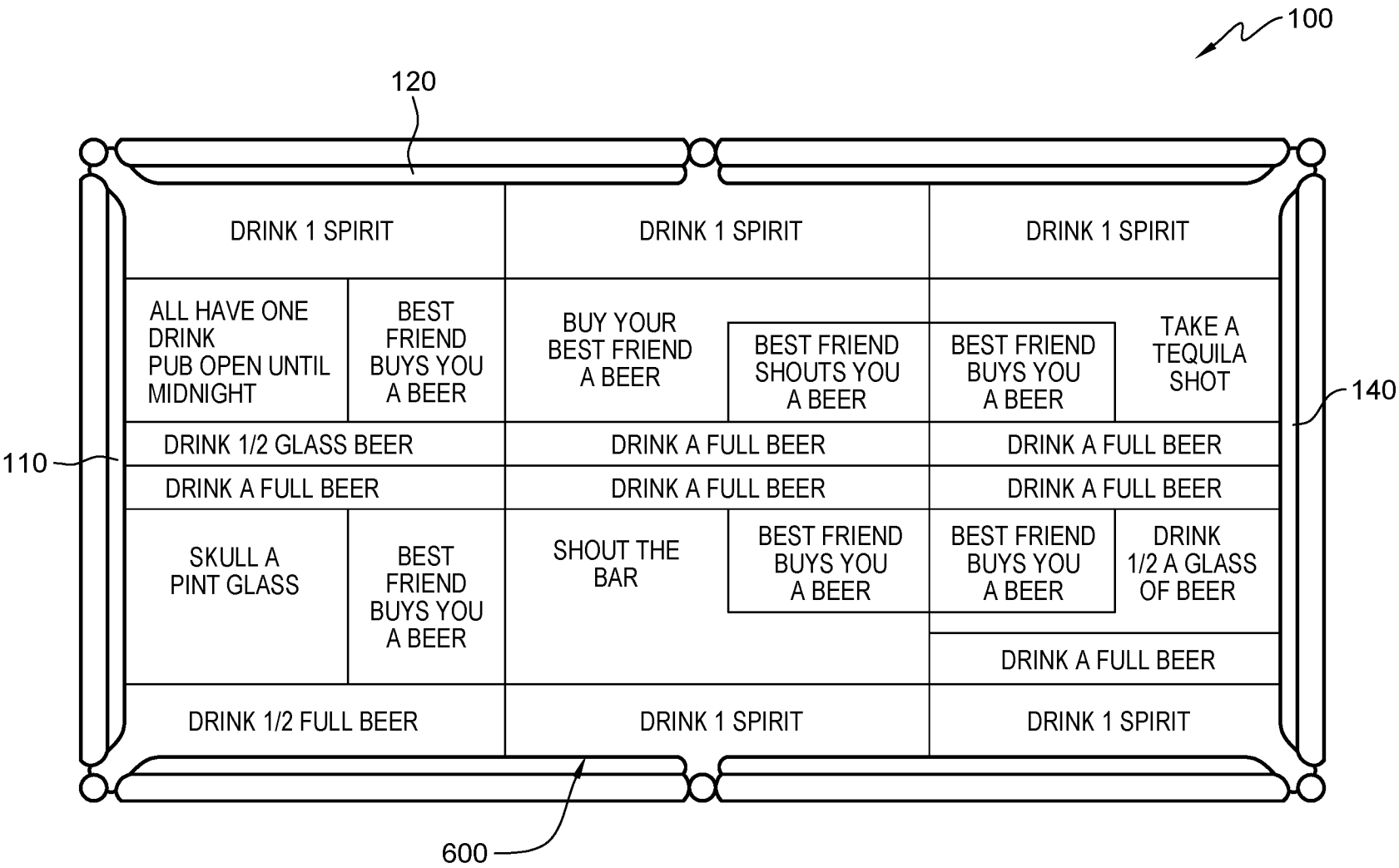

Example 3, FIG. 6, Pub betting/drinking game: In this game the player launches the ball as described prior when the ball comes to rest after completion of turn the result is shown where the ball lies (came to rest) and the player/best friend or pub members benefit from the result according. Each pub member may play in turn. This example can also be applied to the game of 8-ball and where the white (cue) ball comes to rest this gives the required result as attained to the design.

Figure 7:
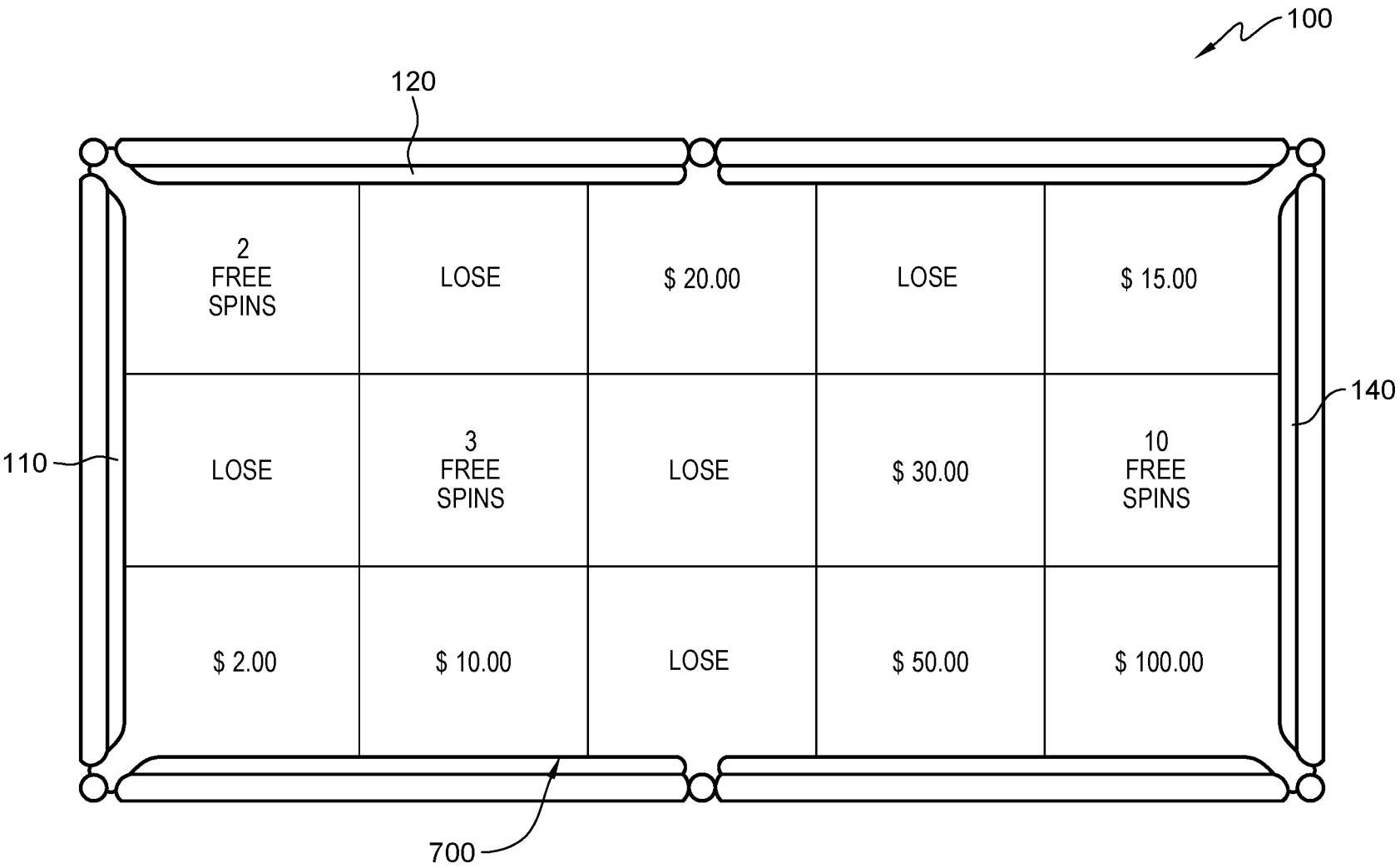

Example 4, FIG. 7, Giant Poker machine mode, pokies/slots: In this preferred embodiment, the billiard table can be used as a giant slot machine with the player launching the ball onto the table as prior described and coming to rest on any of the shown winning or losing places shown on the table layout design. The ball finishes leaving the hand then bounces around the table off three cushions and comes to rest on any given location housing different prizes. This game could also be used in conjunction with normal slot machines (pokies) as a feature presentation and played accordingly. The player would need to swipe the screen in order to have their turn.

Figure 8:
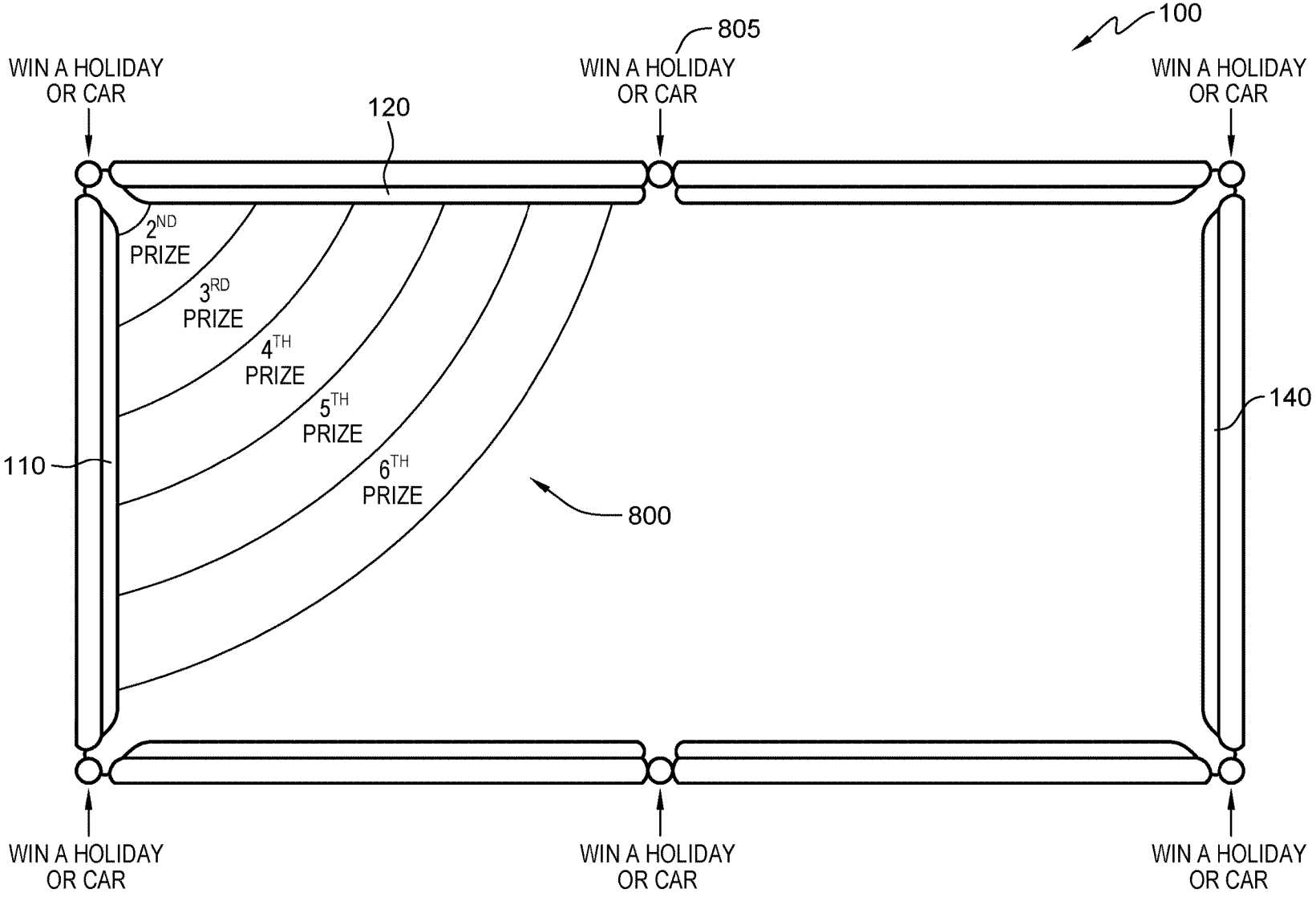

Example 5, FIG. 8, TV Show win a vacation or car theme: In this case the player or contestant launches the ball onto the billiard table in the way as prior described and the ball bounces off at least three cushions and then comes to rest on or in any winning location on the table layout as shown. These winning places (e.g., 2nd, 3rd, 4th, 5th prize) are marked on the table layout as shown. For the contestant or player to win the main prize of a vacation or car etc. they must land the ball in one of the pockets as shown after correct play procedure has been followed.

Figure 9:
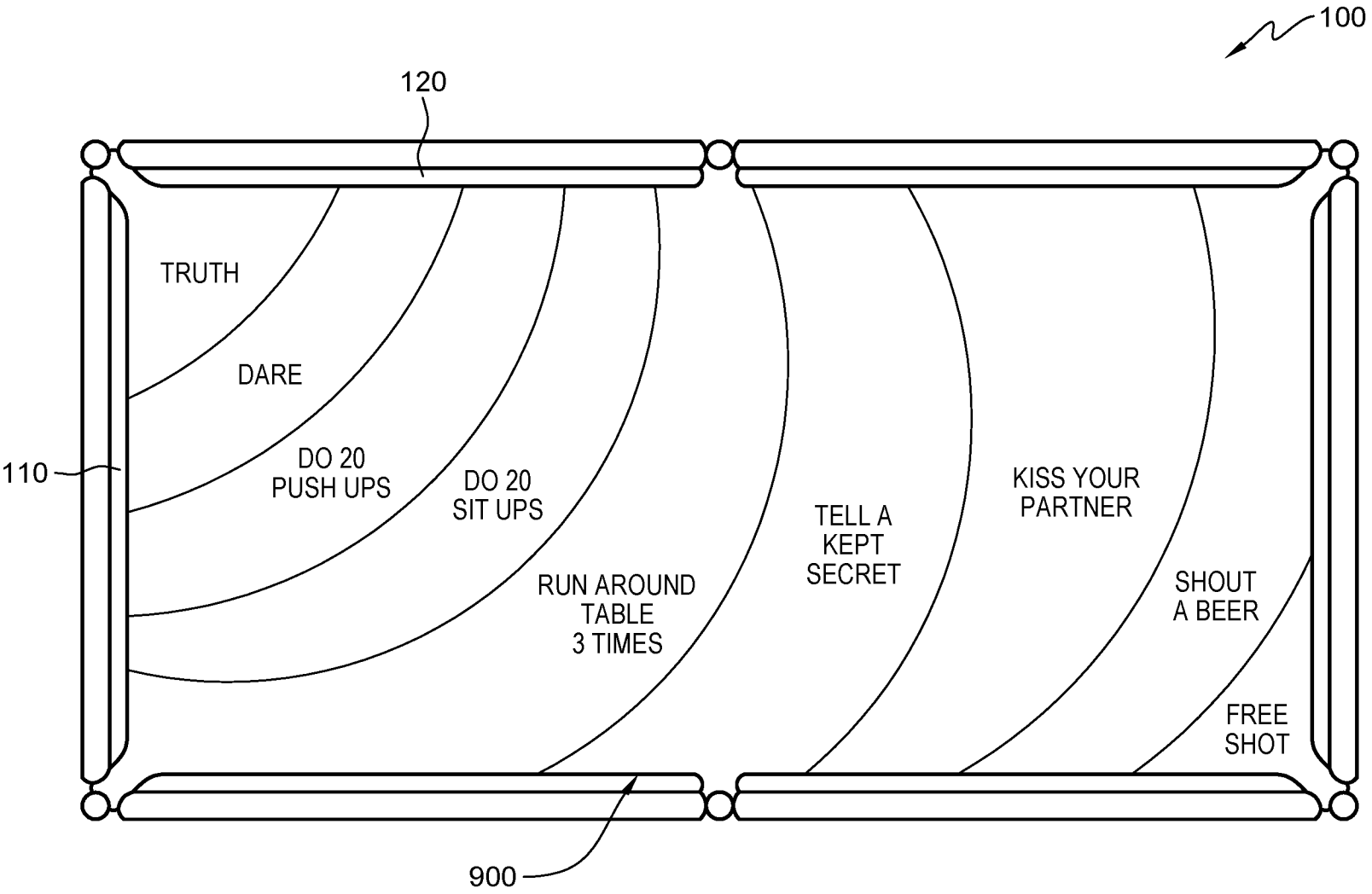

Now the gambling Examples have been shown, additional examples will be described that are playable by family members on their own table using a table layout purchased thru a layout manufacturer:

Example 6, FIG. 9: Family fun; wherever the ball bounces: The player launches the ball as prior described and then the ball comes to rest on a given location on the layout having a particular result as shown in FIG. 6.

Figure 10:
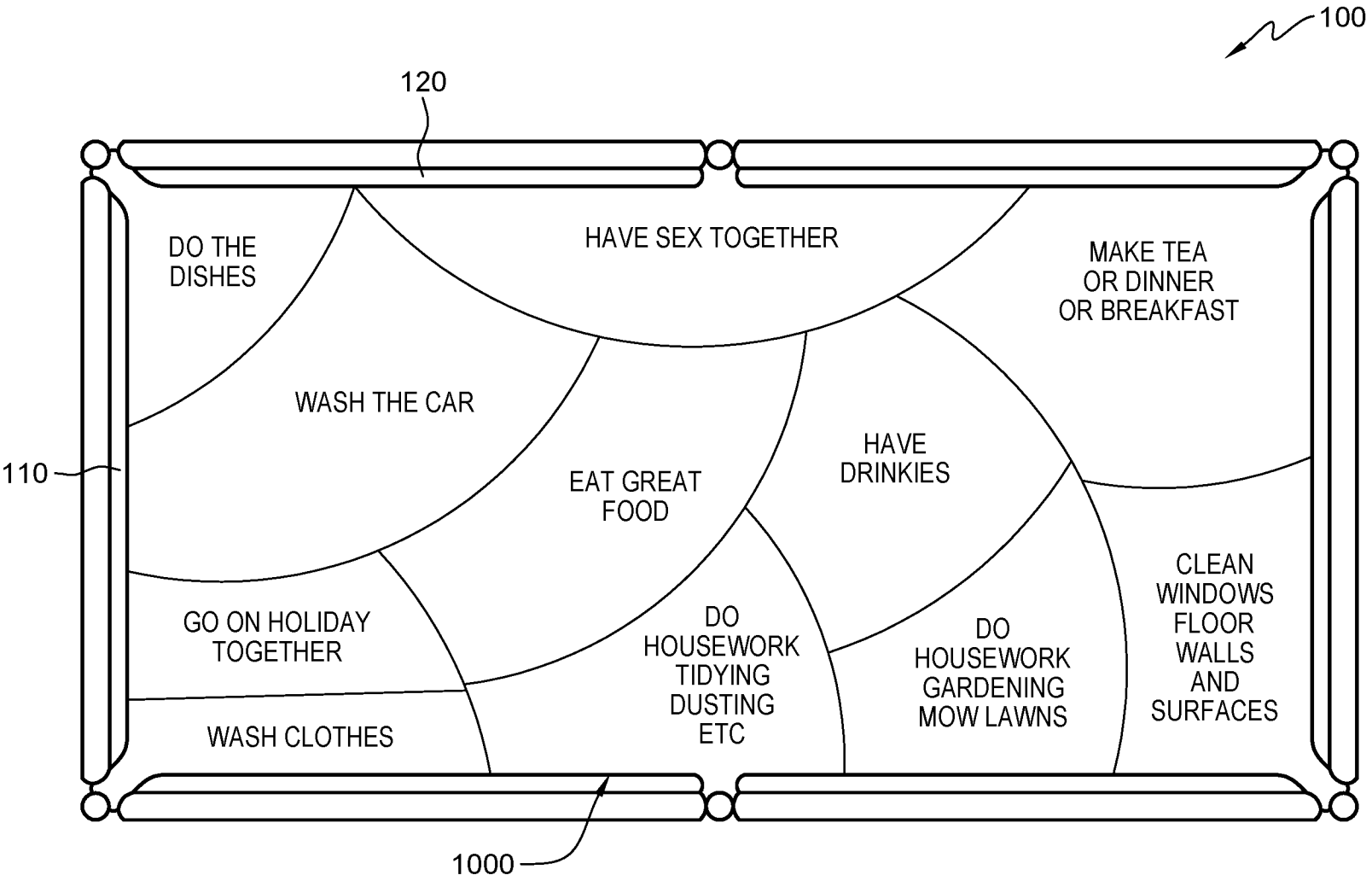

Example 7, FIG. 10; Husband and Wife Game: The player launches the ball onto the billiard table having the design layout as shown in FIG. 7 and following the correct play procedures as prior described. After the first attempt is ready and achieved by the player the ball comes to rest on a place on the table and the instructions written on the place where the ball comes to rest must be followed by the player's partner.

Figure 11:
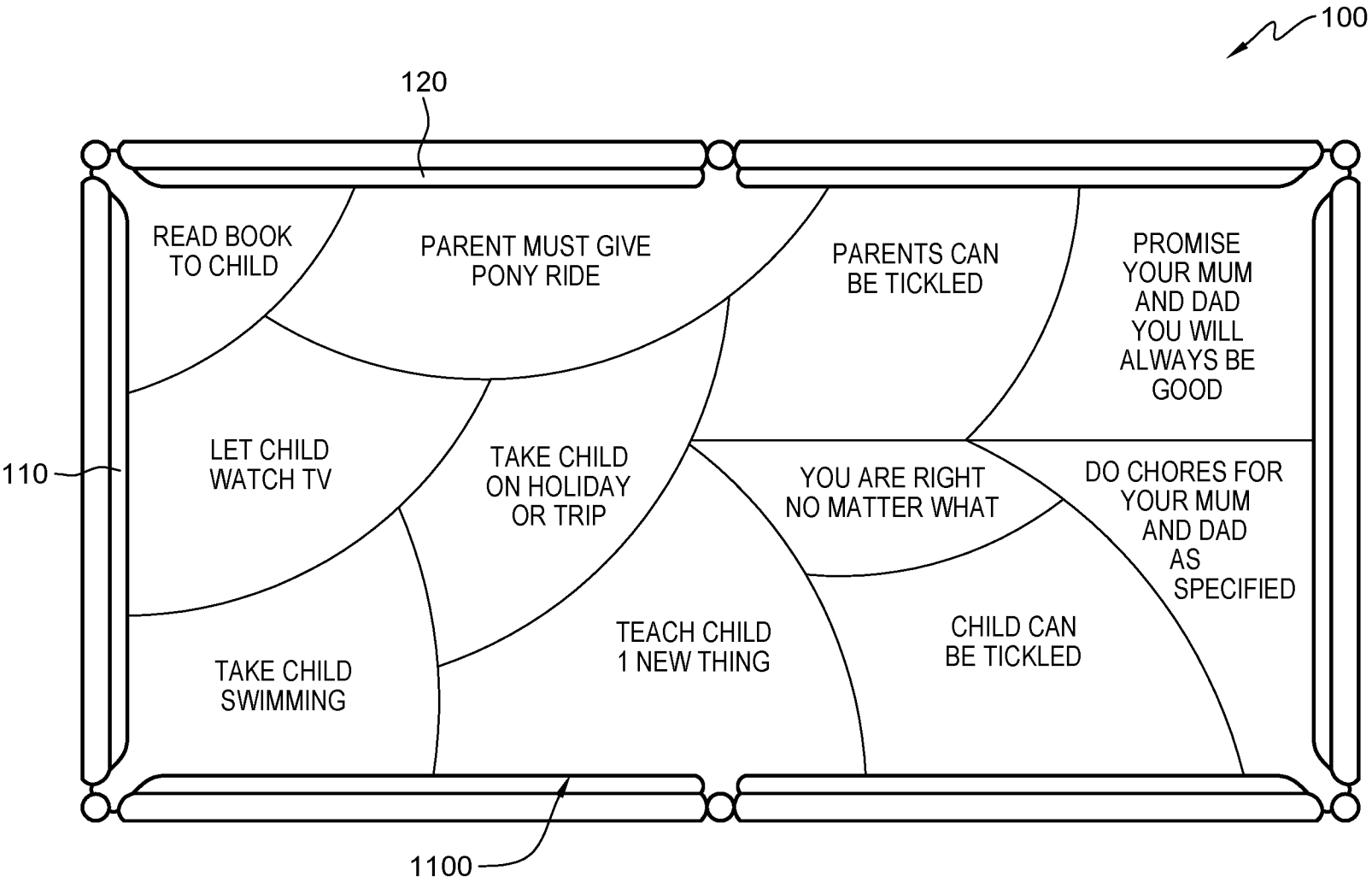

Example 8, FIG. 11; Parent and Child Game: The player launches the ball onto the billiard table in the prior described way when the ball comes to rest on a particular position on the table layout as shown in FIG. 8 then the parent or child (respective of turn) must perform or agree to perform the tasks indicated.

Figure 12:
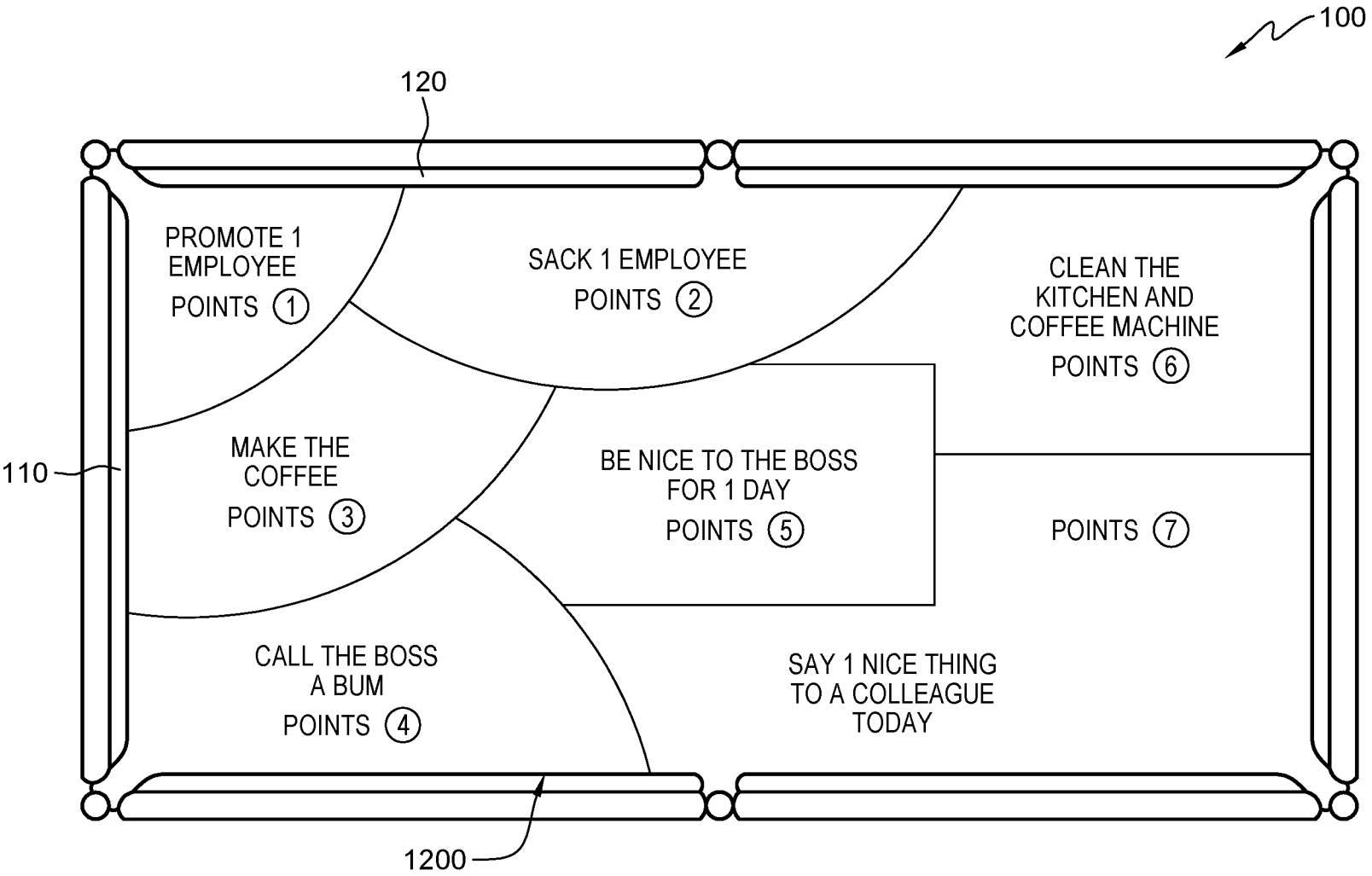

Example 9, FIG. 12; Boss/Employee Game: The player launches the ball onto the billiard table in the pre described way when the ball comes to rest on a particular position on the table layout (after a correct serve) then the boss or employee carries out the task(s) as designated on the spot where the ball has come to rest as shown in FIG. 9.

Figure 13:
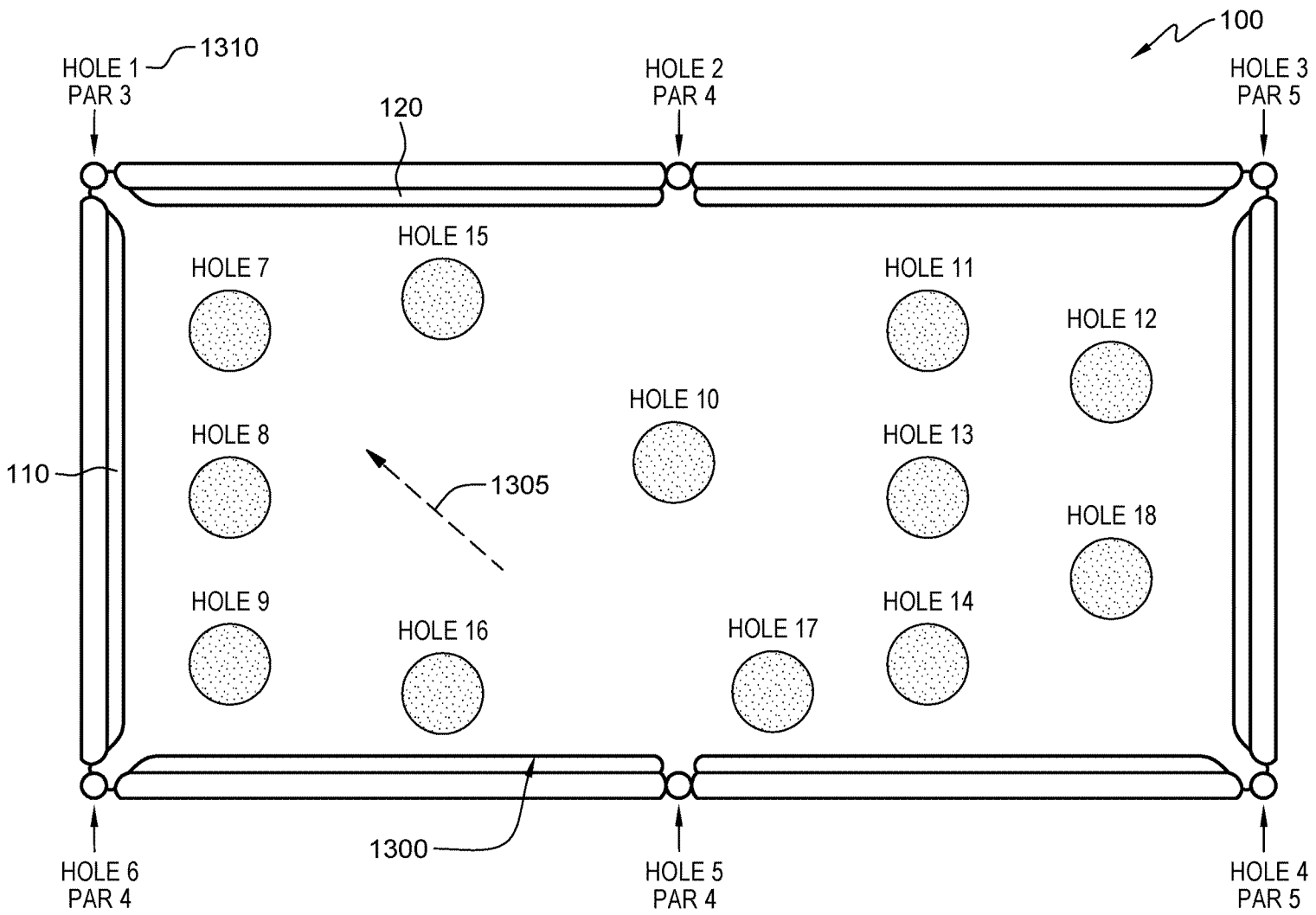

Example 10, FIG. 13; New way of playing golf: The ball is launched by the player onto the billiard table as previously described. After completion of a correct serve when the ball comes to rest, it will be possibly on a location containing a golf hole as designated by the felt/cloth design. A game of golf can be played this way. Players attempt to land the ball in one of the pockets (holes 1 to 6) or on a given hole (holes 7 to 18) located on the table layout as shown in FIG. 10.

Figure 14:
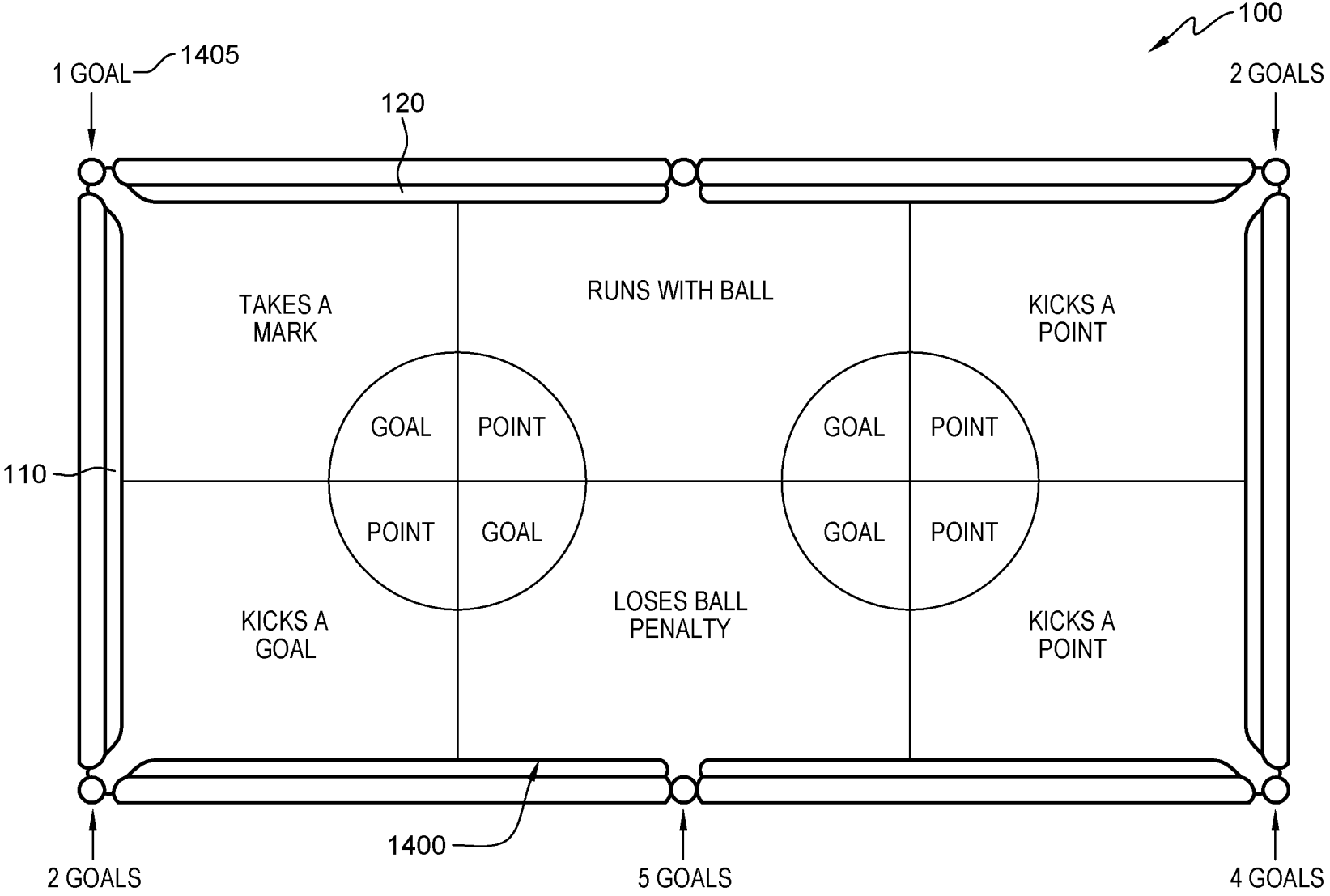

Example 11, FIG. 14; Football Game: In this embodiment, the ball is launched onto the billiard table in the correct way as prior described and after bouncing off cushions as required and satisfying entry standards and then progressing across the table and then finally comes to a resting point (stopping point) on the table layout this will signify the result won by the player, as shown in FIG. 11.

Figure 15:
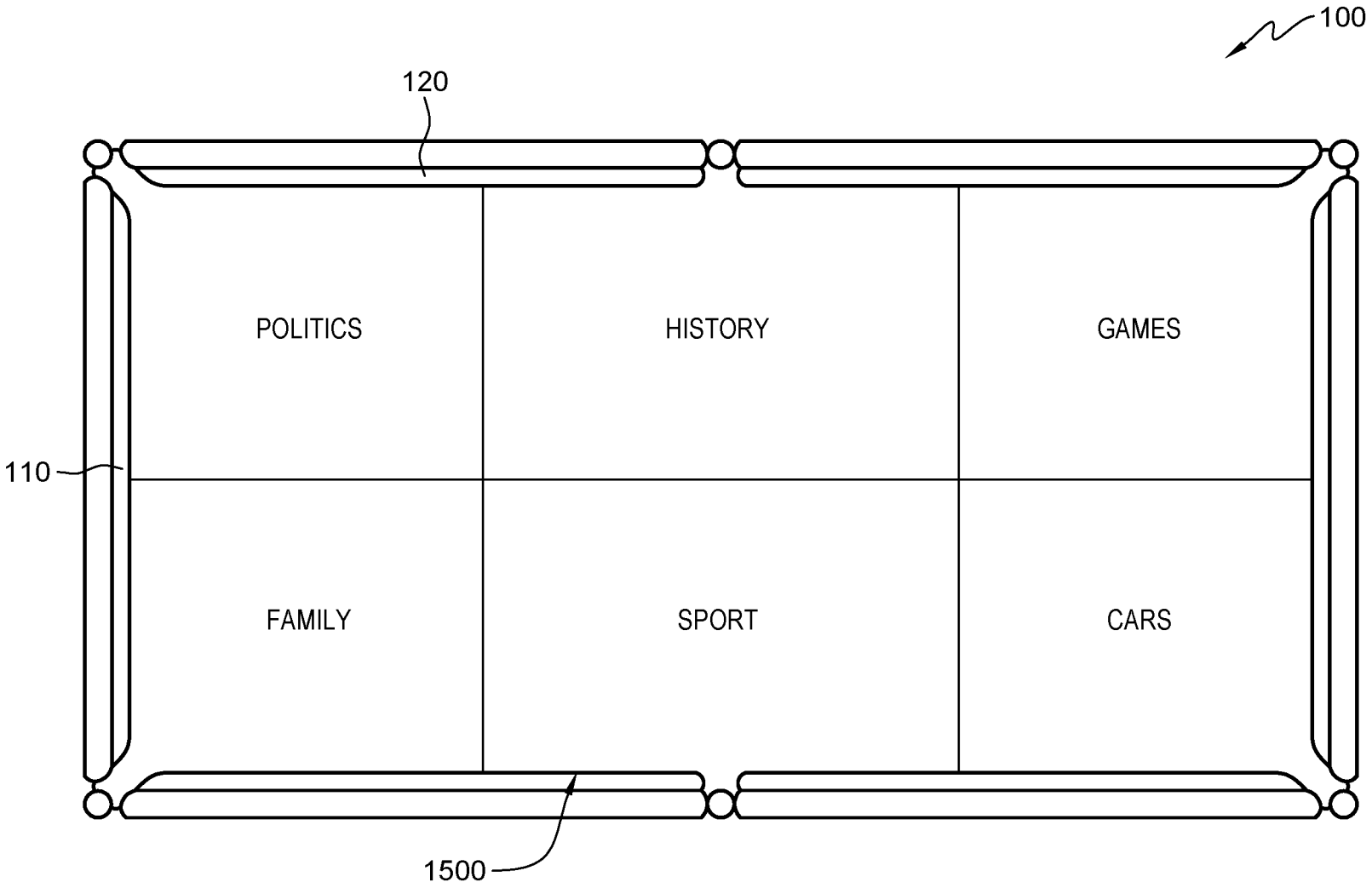

FIG. 15 shows a table gaming surface offering different Question Topics, which could be used for game show contestants or the host of the game show for trying to cause the ball to come to rest on a Favored Topic Question.

Figure 16:
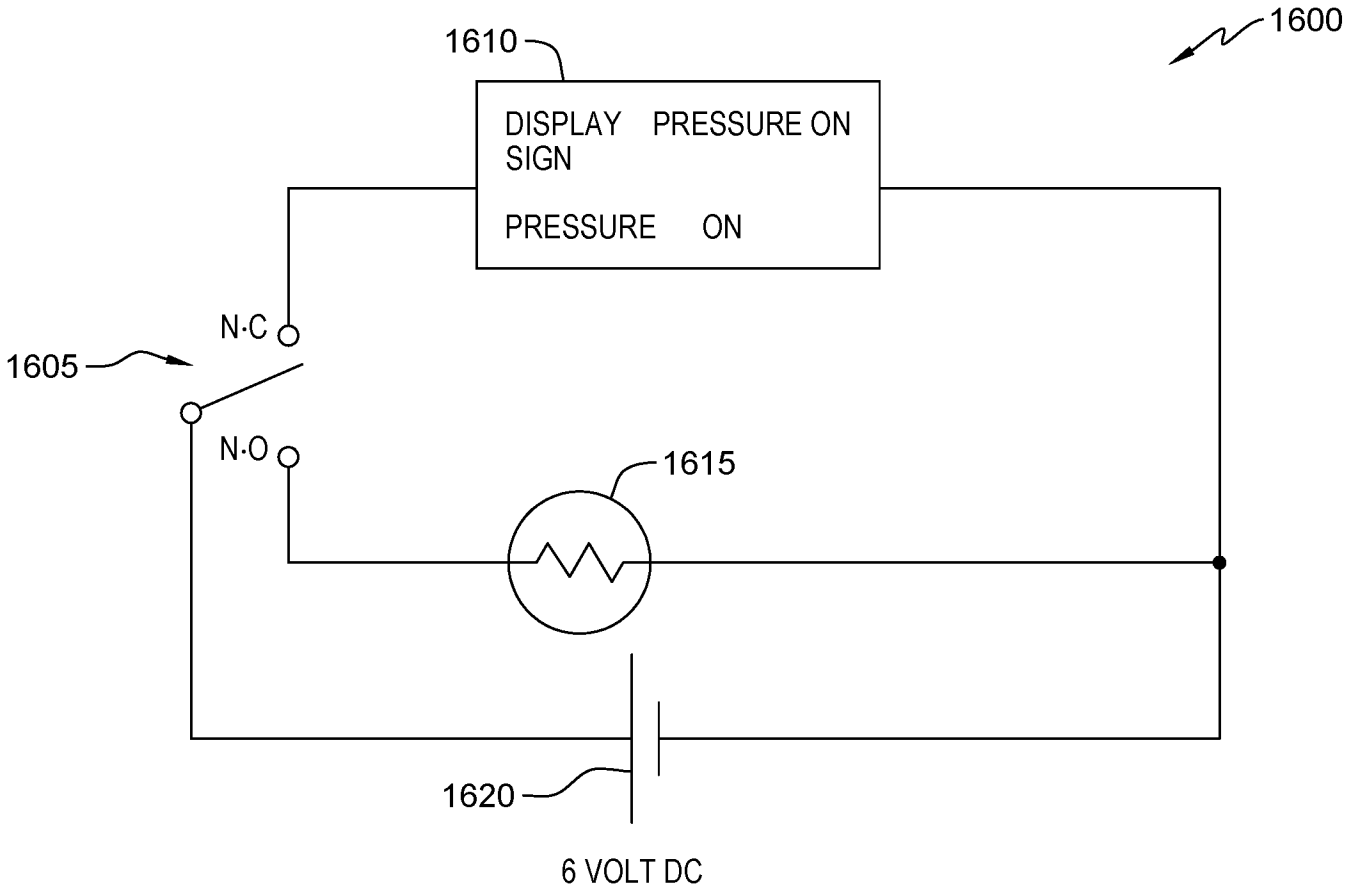

Example 12, as illustrated in FIG. 16; Two players competing against each another: In the case of two players competing an electronic pressure switch is used as a footrest connected to an alarm/buzzer and "Pressure On" indicator. The "Pressure On" indicator may be a light or the written word "Pressure On" indicated on a electronic digital display. To begin "Player A" stands on the Pressure switch causing the alarm or buzzer to turn off at position E or F shown in FIG. 1.

The player then takes his first shot (making sure to keep pressure on the switch during play) then moves off the pressure switch and stands at the bottom of the table (near cushion A) and then Player B takes Player A's prior starting point/position standing on the pressure switch causing the alarm/buzzer to turn off and "Pressure On" is indicated on the electronic display. The Player B then takes his turn and then moves off the pressure switch and stands at the top part of the billiard table near cushion D and E. Player A then moves back into his original starting position onto the pressure switch/mat and begins a new shot (serve/go/delivery.) This process is repeated until a result is known. If a player moves off the pressure switch before or during the serve/shot then the player loses a point and forfeits his turn, as illustrated in FIG. 16, which shows the pressure switch/ footswitch and alarm/buzzer unit. The "Pressure On" indicator and 6-volt DC electricity source.

Additional Information:

1. For ball in pocket or numbered balls over pocket(s) and for competition sports play. The player serves three practice shots first not knocking in any balls as a mode of warm up practice. After completing these three rotations around the table the player now has seven shots (continues for seven attempts) in order to gain a result.

2. If a ball goes into a pocket directly from the hand without touching at least two cushions first then the shot is deemed invalid and must be replayed, no points or score is earned.

3. It may be such that the aim of the game is to put a ball in pocket 1 (as shown in FIG. 2 after completing correct launch and play procedures.

4. Although I have said that the ball must be directed at cushion A to begin play in fact the ball can be aimed at any desired cushion to start the game.

5. Although we refer to the use of a rectangular billiard table it is important to note that any sized or shaped table/surface may be used.

6. Although this disclosure refers to a painted or printed image on the billiard table it is important to note that a electronic light projector may be used to project an image onto the Billiard table, thus, any means of projection of an image onto the table felt is allowed whether by using a projector, computer or by any electronic means.

7. Although we refer to the use of a physical billiard table or snooker table or 8-ball table used in conjunction with the concept it is very possible to use the game concept electronically by means of a computer program and the image of a billiard table is shown on a phone app or computer screen or screen monitor. In the case of a phone app or computer screen or screen monitor it would be necessary to swipe the phone/computer screen/screen monitor in order to play rather than impact the ball with the palm or fingers of the hand.

Additional Modes of Play:

To start the game (i.e., sporting mode) and to warm up each player must deliver 10 goes in a row off the cushions keeping the ball in play always. The player who incorrectly hits the ball and leaves the ball in a "No Play Zone" where it cannot be reached loses. The player with the most points out of 10 wins. (If both players reach 10 serves/goes/turns a coin is tossed to decide who has the first turn at scoring points. This player starts the game. Six balls are placed directly over the pockets (each ball placed over each of the 6 pockets respectively) allowing easy potting of the ball into the pocket, starting from ball 1 to ball 6 the balls, which are valued 1 point for ball 1, 2 points for ball 2, 3 points for ball 3, 4 points for ball 4, 5 points for ball 5 and 6 points for ball 6 and are placed around the table over the pockets, as shown in FIG. 2.

In an alternative preferred embodiment, to begin play the player must shoot three full deliveries/goes/shots without knocking any balls into the pockets. On the fourth shot/go/turn, the ball becomes Active and then becomes Live after bouncing off cushion B. Play then begins, each player takes his turn in order. When loss by location occurs (leaving the ball in a "No Play Zone"), then it's the next player's turn. Any balls which are knocked out of the pockets without going into the pocket/hole are replaced by the referee who puts the ball(s) back over the pocket of origin.

In still a further alternative preferred embodiment of the game of the present invention, a glove may be worn by a player to enable a pain-free serve. In this Example all the pockets of the billiard table have a ball directly in front of each pocket. Players start by directing the ball towards cushion A with the palm of the hand or fingers, after the ball has bounced off the bottom cushion A onto the first side cushion (cushion B) the ball is now live and can knock down any of the balls covering the pockets. Each player is given seven attempts, which continue uninterrupted from start in the attempt to knock in as many balls as possible. Each ball has its own value as is marked on the ball of course 8-ball balls are used here. The ball must be kept moving at all times and the players can only access the ball from the location given (or where the Pressure Switch is located.) Electronic pressure switches are placed on the floor for the players to stand upon. When a players foot leaves a Pressure Switch the alarm sounds and the player loses one point and its now the other players turn. The aim of this mode of play is to get as many balls in the pockets as possible.

Play continues until a win is achieved by either player, with the conditions for winning being, by way of example, as follows:

1. The player with the most points accumulated after seven shots/deliveries;

2. The player who wins the first point or knocks in the first ball;

3. The player who knocks in the highest value ball first; and/or

4. The first player to reach 50 points;

The player must attempt to knock in as many balls as possible off cushion B during play and, if possible, return the ball to play location ready for the next shot after knocking a ball into a pocket.

In a preferred embodiment of the rules:

1. It is illegal to knock in the 6 ball on first action the player must aim the ball towards cushion A for first shot action (first delivery) to enable the ball to become live after bouncing off cushion B;

2: If a player knocks in a ball legally but the ball doesn't return into the play location (ball ends up in a "No Play Zone") then the player forfeits his next go and it is the opponents turn to play;

3. A wooden pin is placed in the middle of the billiard table, any player who knocks this pin down will lose a turn and any points earned by knocking in balls count towards the final score; and/or, 4. All six balls are placed over pockets (directly in front of pockets) at the beginning of each player's respective turn or as required by operator.

It is further possible to have an electronic version of the game of the present invention that can be written as a computer program and played on devices, such as mobile phones as an app on a mobile phone or on a computer monitor screen or on monitor screens used in conjunction with poker machines. Any means of presenting a version or by adding additional entertainment features to play the electronic version is contemplated, either by including electronic items on the table surface by computer programming such as ramps, bells, circular ramps or anything of interest can be applied, including electronic fireworks or electronic projections placed on the table surface of any kind.

While only several embodiments of the present invention have been shown and described, it will be obvious to those skilled in the art that many modifications may be made to the present invention without departing from the spirit and scope thereof.

What is claimed is:

1. A table game, comprising:

a game surface having a plurality of holes therein and a "No Play Zone";

a plurality of balls for contacting said game surface and being of a diameter allowing each ball of said plurality of balls to be passed or thrown into each hole of said plurality of holes;

means for throwing said plurality of balls onto said game surface or into one or more of said plurality of holes; and, means for scoring depending upon location of each said ball of said plurality of balls that is thrown onto said game surface, wherein if a player throws a ball into the "No Play Zone" of said game surface, then the player forfeits a turn and an opponent of the player thereby receives an extra turn of play.

2. The table game according to claim 1, wherein means for throwing said plurality of balls includes a chute that is controlled by a hand of a person.

3. The table game according to claim 1, wherein said plurality of balls are billiard balls.

4. A table game, comprising:

a game surface having a plurality of holes therein and a pin thereon;

a plurality of balls for contacting said game surface and being of a diameter allowing each ball of said plurality of balls to be passed or thrown into each hole of said plurality of holes;

means for throwing said plurality of balls onto said game surface or into one or more of said plurality of holes; and, means for scoring depending upon location of each said ball of said plurality of balls that is thrown onto said game surface, wherein if a player throws a ball onto said game surface and knocks down said pin, then the player forfeits a turn and an opponent of the player thereby receives an extra turn of play.

5. The table game according to claim 4, wherein means for throwing said plurality of balls includes a chute that is controlled by a hand of a person.

6. The table game according to claim 4, wherein said plurality of balls are billiard balls.

7. The table game according to claim 4, wherein said pin on said game surface is made of wood.

* * * * *